US007392809B2

(12) United States Patent
Larson et al.

(10) Patent No.: US 7,392,809 B2
(45) Date of Patent: Jul. 1, 2008

(54) ELECTRICALLY HEATED CIGARETTE SMOKING SYSTEM LIGHTER CARTRIDGE DRYER

(75) Inventors: Steven J. Larson, Richmond, VA (US); John M. Campbell, Chesterfield, VA (US); Robert L. Ripley, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 434 days.

(21) Appl. No.: 10/649,792

(22) Filed: Aug. 28, 2003

(65) Prior Publication Data

US 2005/0045198 A1 Mar. 3, 2005

(51) Int. Cl.
*A24F 13/00* (2006.01)
*A24F 17/00* (2006.01)
*A24F 25/00* (2006.01)

(52) U.S. Cl. ..... 131/329; 131/328; 219/222

(58) Field of Classification Search ..... 131/194, 131/243

See application file for complete search history.

(56) References Cited

U.S. PATENT DOCUMENTS 3,586,820 A * 6/1971 Yamanaka ..... 219/222
5,179,966 A 1/1993 Losee et al.
5,222,185 A 6/1993 McCord, Jr.
5,249,586 A 10/1993 Morgan et al.
5,269,327 A 12/1993 Counts et al.
5,388,594 A 2/1995 Counts et al.
5,505,214 A 4/1996 Collins et al.
5,530,225 A 6/1996 Hajaligol
5,591,368 A 1/1997 Fleischhauer et al.
5,726,421 A 3/1998 Fleischhauer et al.
5,878,752 A 3/1999 Adams et al.
5,934,289 A 8/1999 Watkins et al.
5,954,979 A 9/1999 Counts et al.
5,967,148 A 10/1999 Harris et al.
6,053,176 A 4/2000 Adams et al.
6,116,247 A 9/2000 Banyasz et al.
6,119,700 A 9/2000 Fleischhauer et al.
6,125,866 A 10/2000 Nichols et al.
6,418,938 B1 7/2002 Fleischhauer et al.

* cited by examiner

*Primary Examiner*—Steven P. Griffin
*Assistant Examiner*—Phu H Nguyen
(74) *Attorney, Agent, or Firm*—Buchanan Ingersoll & Rooney P.C.

(57) ABSTRACT

A dryer for a smoking device includes a heating element adapted to fit within a cigarette receiving portion of the smoking device, the heating element projecting from a base portion of the dryer. The base portion of the dryer has an interface surface on which the smoking device rests when the heating element is positioned within the cigarette receiving portion of the smoking device. At least one air passageway is provided in the base portion of the dryer to communicate between the cigarette receiving portion and surrounding ambient air when the smoking device rests on the interface surface.

5 Claims, 3 Drawing Sheets

ELECTRICALLY HEATED CIGARETTE SMOKING SYSTEM LIGHTER CARTRIDGE DRYER

BACKGROUND

Commonly assigned U.S. Pat. Nos. 5,388,594; 5,505,214; 5,530,225; 5,591,368; and 6,418,938 disclose various electrically powered smoking systems comprising electric lighters and cigarettes and devices for cleaning the heater fixture of the smoking device, and are hereby expressly incorporated herein by reference.

SUMMARY

According to one embodiment, a dryer is provided including a heating element adapted to fit within a cigarette receiving portion of a smoking device, the heating element projecting from a base portion of the dryer, and the base portion having an interface surface on which the smoking device rests when the heating element is positioned within the cigarette receiving portion of the smoking device. At least one air passageway is provided in the base portion of the dryer in communication between the cigarette receiving portion of the smoking device and surrounding ambient air when the smoking device rests on the interface surface.

According to another embodiment, a method of cleaning a smoking device includes introducing a cleaning solution such as an aqueous medium within the cigarette receiving cavity of the smoking device. After the cigarette smoking device has been cleaned, the smoking device is placed on a dryer wherein the dryer includes a base portion and a heating element adapted to fit within the cigarette receiving cavity. The base portion of the dryer has an interface surface on which the smoking device rests when the heating element is positioned within the cigarette receiving cavity, and at least one air passageway is defined in the base portion to communicate with both the cavity and the surrounding ambient air. Electrical current is supplied to the heating element to increase the temperature of the heating element and thereby increase the rate at which the cleaning solution is evaporated from within the cavity.

DETAILED DESCRIPTION

During operation of an electrically heated smoking system, condensate can collect on various parts of the heating fixture. In order to remove such condensates, the smoking device may include a heating component which is used to drive off such condensates. Even with such a heating component, it may not be possible to remove as much of the condensates as desired. Further, the smoking pleasure derived from the smoking system may be adversely affected by condensate build-up in areas which cannot be sufficiently heated to drive off the condensates.

U.S. Pat. No. 6,418,938 discloses several embodiments of cleaning units wherein a heater fixture can be washed with a liquid by a movable brush. A heater fixture is attached to the second end of a tube having a first and a second end. An aqueous medium is supplied to the first end of the tube such that the aqueous medium flows through the tube and an opening in the heater fixture and out the second end of the tube. A bristled portion of a brush, the brush having a handle disposed in and axially movable relative to an opening through a wall in the tube, is moved through the opening in the heater fixture. After a cleaning process such as that disclosed in U.S. Pat. No. 6,418,938, the internal portions of the heater fixture that have been exposed to the aqueous medium retain a certain amount of the moisture. It would be desirable to remove that moisture as quickly as possible such that the heater fixture can once again be installed within an electrically heated cigarette smoking system and used to smoke a cigarette.

Figure 1:
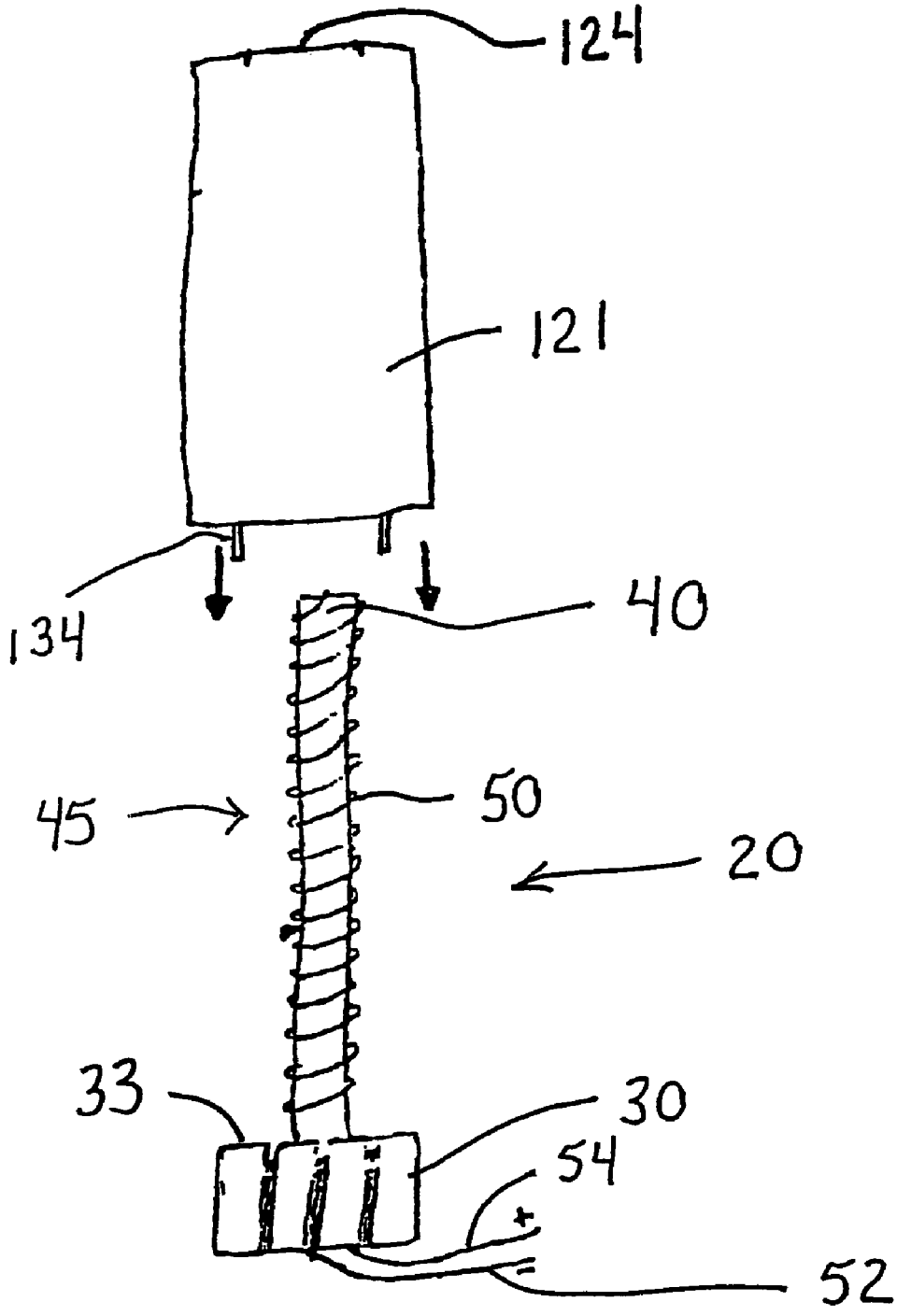
FIG. 1 is an assembly view of an embodiment showing a heater fixture from an electrically heated cigarette smoking system positioned to be placed over a heating element on a dryer.
Figure 4:
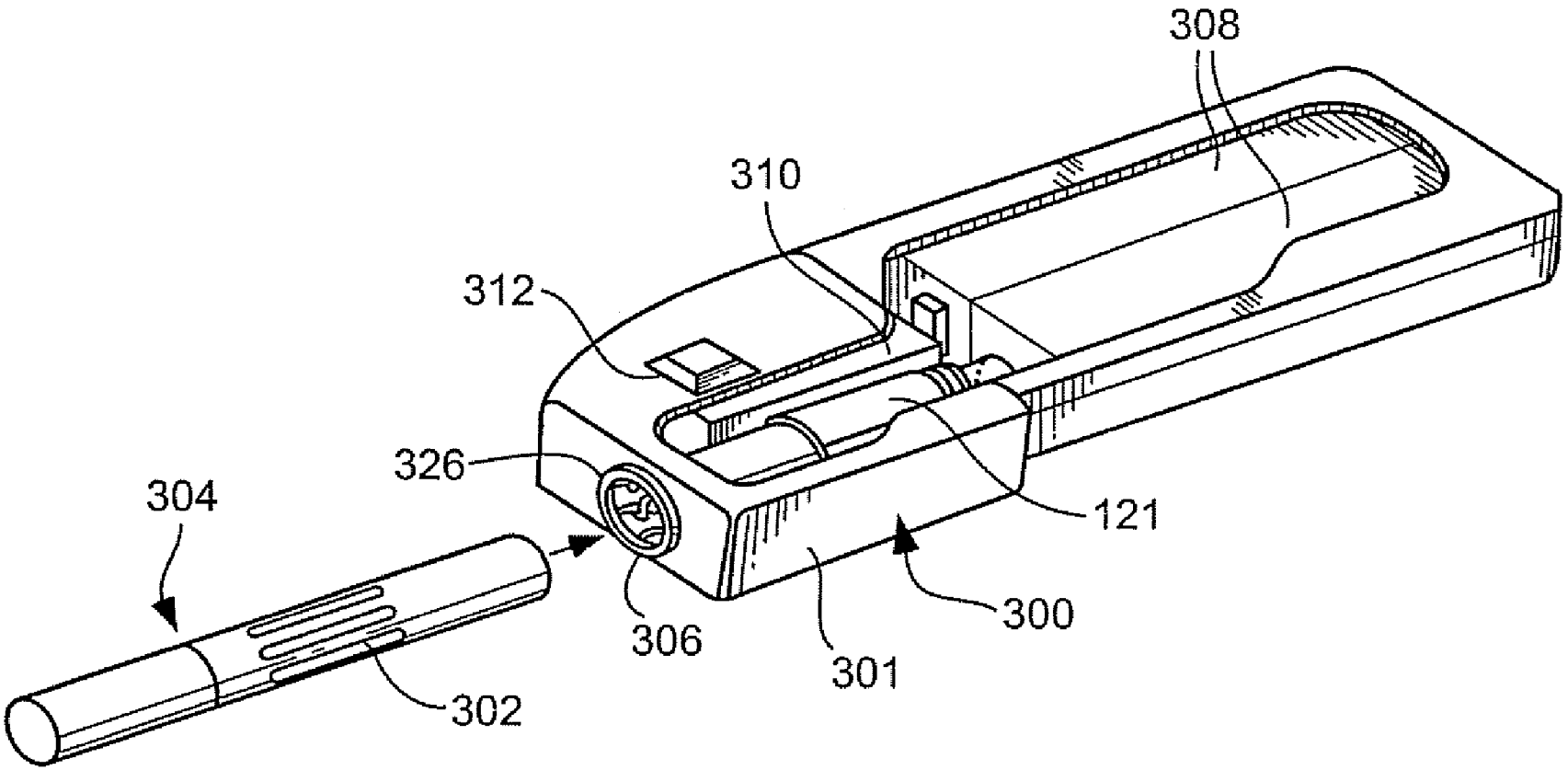
FIG. 4 (Prior Art)
FIG. 4 is a perspective view of a smoking system for use with a drying apparatus.
Figure 2:
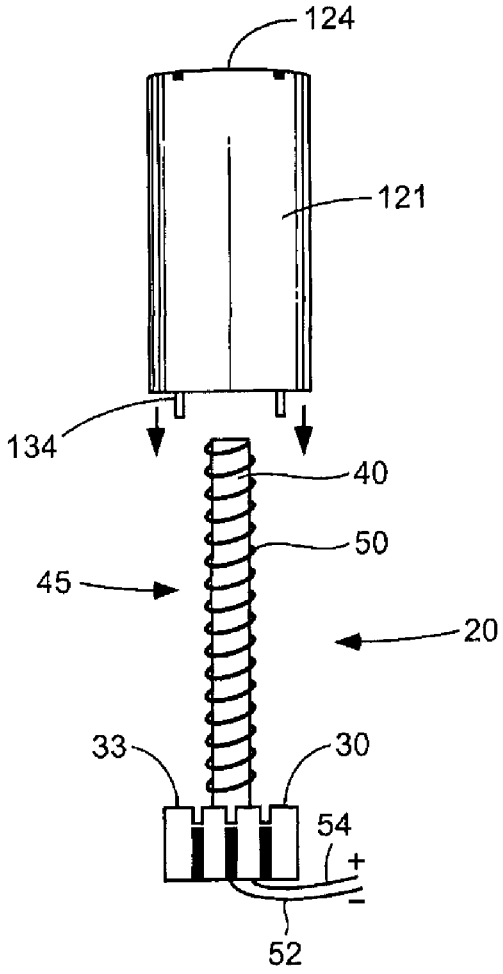
Figure 3:
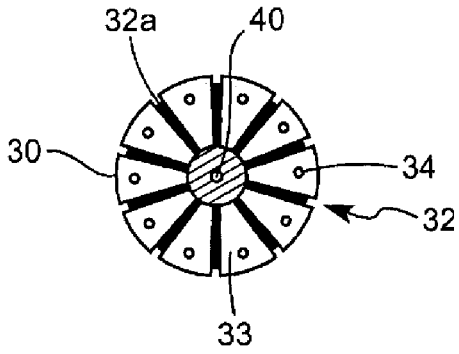
Figure 3:
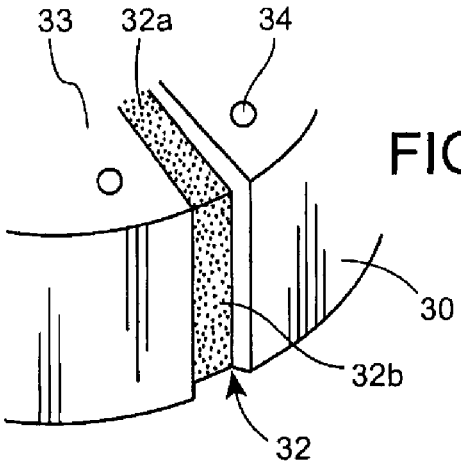
Figure 4:
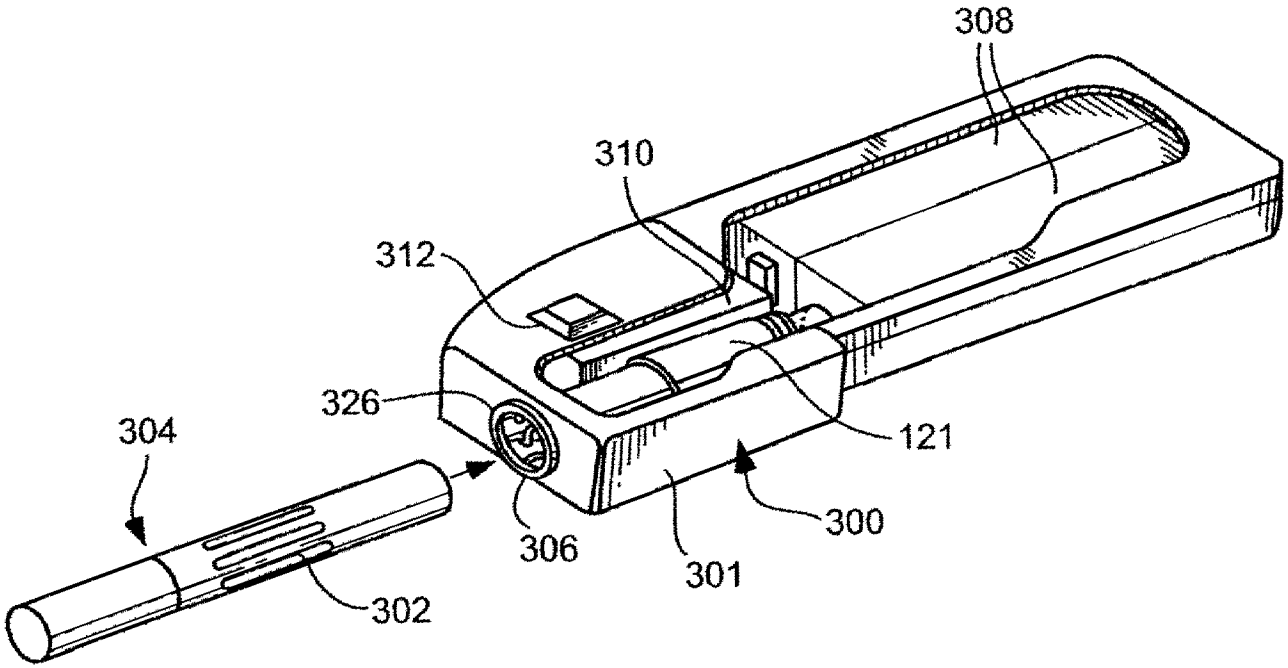
Figure 4:
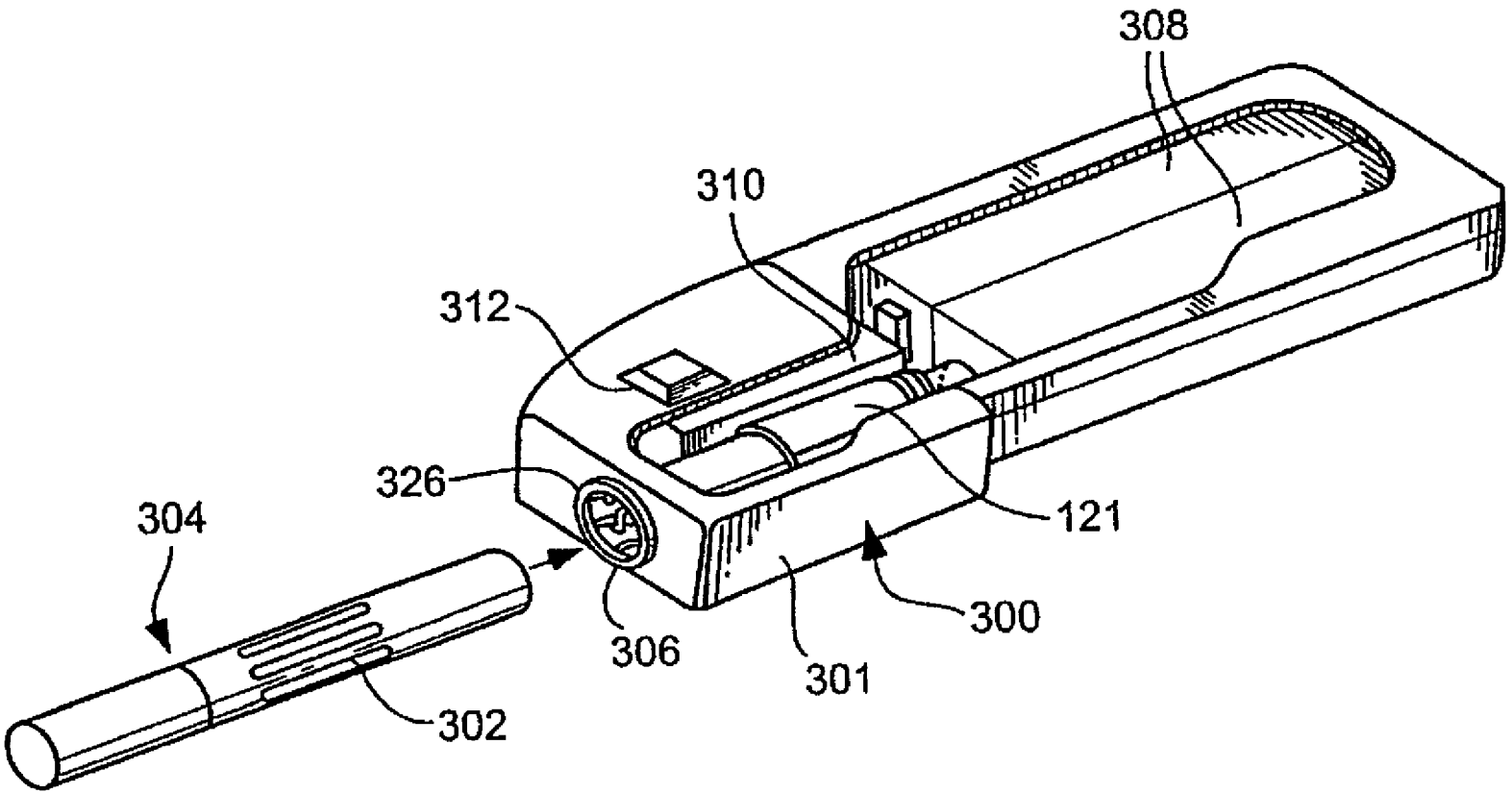
FIG. 4 (Prior Art)

A smoking system is shown in FIG. 4. Details of the electrically powered smoking system shown in FIG. 4 can be found in U.S. Pat. Nos. 5,388,594; 5,505,214; 5,530,225; and 5,591,368. As shown in FIG. 4, a smoking system 300 includes a lighter 301 and a cigarette 304. The lighter 301 includes a removable heater fixture 121. The heater fixture 121 includes heating blades 326, which are electrically powered to heat a region 302 along a cigarette 304. As shown in FIG. 1, the heater fixture 121 includes a cigarette receiving opening 124 at one end, and a terminal base having protruding electrical connector pins 134 at the opposite axial end. Electricity is supplied to the heating blades 326 from a power source through the electrical connector pins 134. The cigarette 304 is smoked by inserting the cigarette 304 in the opening 306 of the lighter 301. The cigarette 304 passes through the opening 306 in the lighter 301 and into the opening 124 of the heater fixture 121. The smoking system 300 also includes batteries 308, a logic circuit 310, and a display 312 for indicating the number of puffs remaining to be smoked. During use of the smoking system 300, condensates from the cigarette smoke accumulate in the heater fixture 121. In order to clean the heater fixture 121, the heater fixture may be removed from the smoking system 300 and placed in a holder of a cleaning unit.

After the heater fixture 121 has been cleaned, a dryer can be used to rapidly remove any remaining cleaning fluid from within the heater fixture 121 before installing the heater fixture 121 back in the lighter 301 of the smoking system 300.

According to a preferred embodiment, a dryer 20 includes a base portion 30 and a heating element 45 in the form of a rod 40 projecting from the base portion 30 and being wrapped with a resistive wire 50. The rod or post 40 wrapped in resistive wire 50 is adapted to be inserted into the central axial opening through the heater fixture 121. As shown in FIG. 1, the rod 40 can extend from a central portion of the base portion 30 such that when the heater fixture 121 is lowered over the rod 40 it will come to rest on a top interface surface 33 of the base portion 30.

The dryer can be constructed in various configurations. For instance, the rod 40 can be made from an aluminum oxide ceramic material, and the resistive wire 50 can be nichrome wire. In an example, 60 turns of the nichrome wire around the aluminum oxide ceramic rod 40 provides approximately 25 Ohms of resistance. When connected to a source of power such as a direct current power supply suitable for recharging the batteries 308 in the smoking system 300, a dryer 20 constructed according to the above parameters for this example has been found to draw approximately 0.48 Amperes of current at the nominal 12 Volts DC supplied by the power supply. Other configurations can include the rod 40 made from other insulating materials, and the wire 50 made from other resistive materials. The number of turns of the wire would also be varied depending on the desired heat output, resistance of the wire, power source etc.

Figure 2:
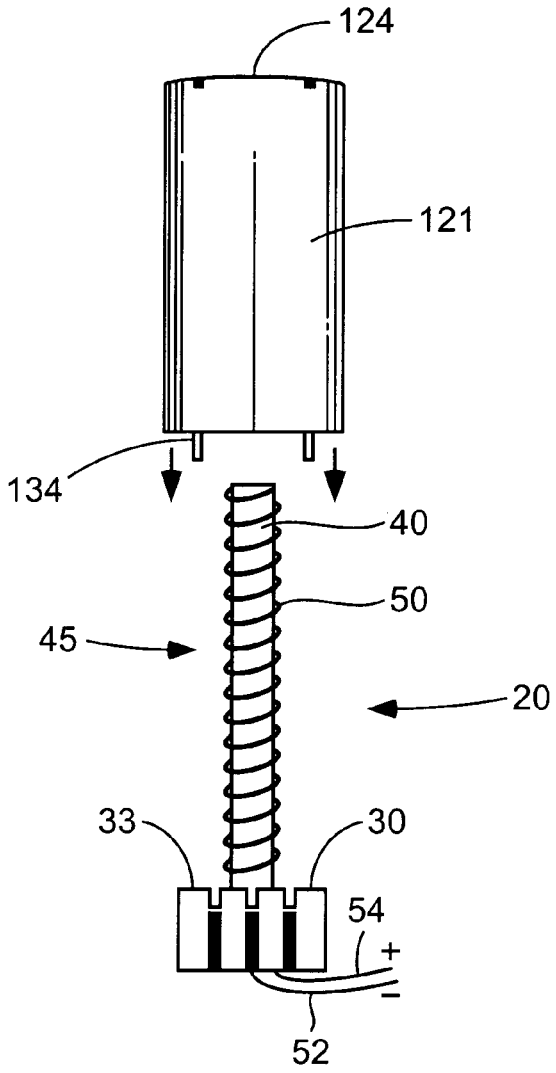
FIG. 2 is a top view of the dryer shown in FIG. 1.
Figure 3:
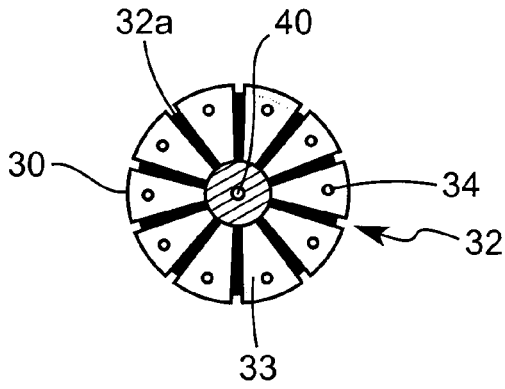
FIG. 3 is an enlarged perspective view of a portion of the base of the dryer shown in FIGS. 1 and 2.
Figure 3:
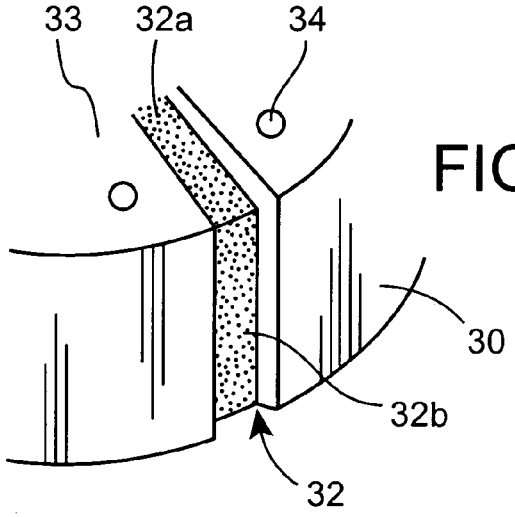

The interface surface 33 of base portion 30 can also be provided with a keying feature such as a plurality of openings 34, shown in FIGS. 2 and 3, that are positioned to mate with electrical pin connectors 134 extending from the heater fixture 121. The resistive wire 50 wrapped around the post or rod 40 can be connected at opposite ends 52, 54 to a source of electrical power. One of the ends of the wire 50 can be passed down through a hole in the rod 40 from the top of the rod to the base portion 30, and then through the base portion 30 to form one of the ends 52, 54.

As shown in detail in FIG. 3, the base portion 30 can be provided with air passageways 32 in the form of slot 32*a* extending in a radial direction along the interface surface 33 and a slot 32*b* extending in an axial direction along the outer periphery of the base portion 30. The air passageway 32 provides a path for air to enter into the heater fixture 121 when it is seated on the base portion 30 and being heated by the heating element 45 made up of rod 40 wrapped in resistive wire 50. The axial slots 32*b* provide air passageways in case the base portion 30 is set down into a supporting fixture of a desired configuration (not shown) where the fit between the outer periphery of base portion 30 and the inside surface of the supporting fixture would not leave enough of an air passageway.

During operation of the heater 20, with the heater fixture 121 resting on base portion 30 of the heater 20, air enters along air passageways 32 into the interior of the heater fixture 121 and is heated as electrical power is provided to the resistive wire 50 around rod 40. The heated air rises through the heater fixture 121, and the heating blades 326 and other interior portions of the heater fixture 121 are heated by thermal radiation from the heating element 45 and convection. The heating results in evaporation of any residual cleaning fluid remaining within the heater fixture 121, with the heated moist air rising out of the heater fixture through opening 124.

In a preferred embodiment, the base portion 30 of heater 20 can be molded from a heat resistant plastic material able to withstand the elevated temperatures that will be reached as electrical power is supplied to the resistive wire 50 around rod 40. The rod or post 40 is preferably made from an insulating material such as an aluminum-oxide ceramic material, although any suitable insulating materials could also be used. Parameters including but not limited to the number of turns of the resistive wire 50 around rod 40, the overall resistance of the length of resistive wire, the electrical power supplied to the heater, and the amount of current supplied through the resistive wire 50 can be chosen such that application of the electrical power to the resistive wire 50 generates temperatures in the range from approximately 200° C. to approximately 275° C. within the heater fixture 121 when the heater fixture 121 is resting on base portion 30 and the rod 40 and resistive wire 50 are positioned in the interior of the heater fixture 121. It has been determined that temperatures of approximately 250° C. at the heating element 45 result in surface temperatures on the heating blades 326 within the heater fixture 121 of approximately 150° C. At these temperatures the desired level of dryness within the heater fixture 121 can be achieved in a period of approximately 10 minutes.

While this invention has been illustrated and described in accordance with a preferred embodiment, it is recognized that variations and changes may be made therein without departing from the invention as set forth in the claims.

What is claimed is:

1. A dryer for an electrically heated smoking device, comprising:

a heater adapted to fit within a cigarette receiving portion of said electrically heated smoking device, said heater projecting from a base portion of said dryer, said base portion having an interface surface on which said electrically heated smoking device rests when said heater is positioned within said cigarette receiving portion of said electrically heated smoking device, and wherein said base portion includes at least one air passageway in communication between said cigarette receiving portion and surrounding ambient air when said electrically heated smoking device is resting on said interface surface, and wherein said interface surface includes a key to position said electrically heated smoking device relative to said dryer.

2. The dryer according to claim 1, wherein said key comprises a plurality of pin connector holes adapted to receive electrical connector pins on said electrically heated smoking device.

3. A dryer for an electrically heated smoking device, comprising:

a heater adapted to fit within a cigarette receiving portion of said electrically heated smoking device, said heater projecting from a base portion of said dryer, said base portion having an interface surface on which said electrically heated smoking device rests when said heater is positioned within said cigarette receiving portion of said electrically heated smoking device, and wherein said interface surface comprises slots formed in said interface surface to provide air passageways communicating with said cigarette receiving portion and surrounding ambient air.

4. The dryer according to claim 3, wherein said slots extend from said heater along said interface surface radially outward to an outer periphery of said base portion of said dryer.

5. The dryer according to claim 4, wherein said slots extend along said outer periphery of said base portion in an axial direction from said interface surface.

* * * * *

UNITED STATES PATENT AND TRADEMARK OFFICE

CERTIFICATE OF CORRECTION

PATENT NO. : 7,392,809 B2
APPLICATION NO. : 10/649792
DATED : July 1, 2008
INVENTOR(S) : Larson et al.

It is certified that error appears in the above-identified patent and that said Letters Patent is hereby corrected as shown below:

The title page should be deleted and substitute therefor the attached title page.

Delete Drawing sheets 1-2, and substitute therefor the drawing sheets, consisting of FIGS. 1-4 as shown on the attached pages.

Signed and Sealed this

Fifteenth Day of December, 2009

David J. Kappos

David J. Kappos
*Director of the United States Patent and Trademark Office*

(12) United States Patent
Larson et al.

(10) Patent No.: US 7,392,809 B2
(45) Date of Patent: Jul. 1, 2008

(54) ELECTRICALLY HEATED CIGARETTE SMOKING SYSTEM LIGHTER CARTRIDGE DRYER

(75) Inventors: Steven J. Larson, Richmond, VA (US); John M. Campbell, Chesterfield, VA (US); Robert L. Ripley, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 434 days.

(21) Appl. No.: 10/649,792

(22) Filed: Aug. 28, 2003

(65) Prior Publication Data

US 2005/0045198 A1 Mar. 3, 2005

(51) Int. Cl.
*A24F 13/00* (2006.01)
*A24F 17/00* (2006.01)
*A24F 25/00* (2006.01)

(52) U.S. Cl. ..... 131/329; 131/328; 219/222

(58) Field of Classification Search ..... 131/194, 131/243

See application file for complete search history.

(56) References Cited

U.S. PATENT DOCUMENTS 3,586,820 A * 6/1971 Yamanaka ..... 219/222
5,179,966 A 1/1993 Losee et al.
5,222,185 A 6/1993 McCord, Jr.
5,249,586 A 10/1993 Morgan et al.
5,269,327 A 12/1993 Counts et al
5,388,594 A 2/1995 Counts et al
5,505,214 A 4/1996 Collins et al.
5,530,225 A 6/1996 Hajaligol
5,591,368 A 1/1997 Fleischhauer et al.
5,726,421 A 3/1998 Fleischhauer et al.
5,878,752 A 3/1999 Adams et al.
5,934,289 A 8/1999 Watkins et al.
5,954,979 A 9/1999 Counts et al.
5,967,148 A 10/1999 Harris et al.
6,053,176 A 4/2000 Adams et al.
6,116,247 A 9/2000 Banyasz et al.
6,119,700 A 9/2000 Fleischhauer et al.
6,125,866 A 10/2000 Nichols et al.
6,418,938 B1 7/2002 Fleischhauer et al.

* cited by examiner

*Primary Examiner*—Steven P. Griffin
*Assistant Examiner*—Phu H Nguyen
(74) *Attorney, Agent, or Firm*—Buchanan Ingersoll & Rooney P.C.

(57) ABSTRACT

A dryer for a smoking device includes a heating element adapted to fit within a cigarette receiving portion of the smoking device, the heating element projecting from a base portion of the dryer. The base portion of the dryer has an interface surface on which the smoking device rests when the heating element is positioned within the cigarette receiving portion of the smoking device. At least one air passageway is provided in the base portion of the dryer to communicate between the cigarette receiving portion and surrounding ambient air when the smoking device rests on the interface surface.

5 Claims, 3 Drawing Sheets

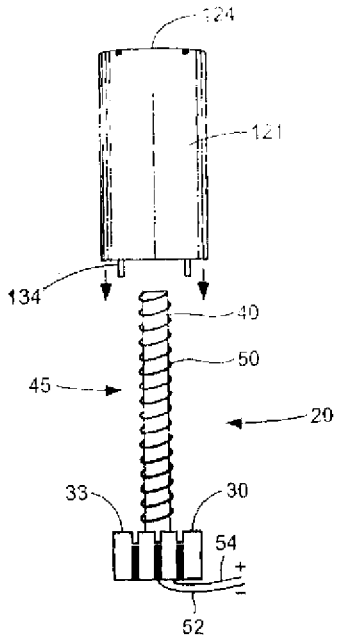

UNITED STATES PATENT AND TRADEMARK OFFICE

CERTIFICATE OF CORRECTION

PATENT NO. : 7,392,809 B2
APPLICATION NO. : 10/649792
DATED : July 1, 2008
INVENTOR(S) : Steven J. Larson et al.

It is certified that error appears in the above-identified patent and that said Letters Patent is hereby corrected as shown below:

On the Title Pg showing illustrative Fig. should be deleted and substitute the attached title page.

Delete Page 3 of 5 of the drawings Fig. 1.

Delete Fig. 4, and substitute sheet, consisting of Fig. 4 as shown on attached pages.

On sheet 4 of 5 of the drawings, insert --FIG. 1-- next to the first figure (drawing containing numerals "124", "121", "134", etc.).

Signed and Sealed this

Sixteenth Day of February, 2010

David J. Kappos

David J. Kappos
*Director of the United States Patent and Trademark Office*

(12) United States Patent
Larson et al.

(10) Patent No.: US 7,392,809 B2
(45) Date of Patent: Jul. 1, 2008

(54) ELECTRICALLY HEATED CIGARETTE SMOKING SYSTEM LIGHTER CARTRIDGE DRYER

(75) Inventors: Steven J. Larson, Richmond, VA (US); John M. Campbell, Chesterfield, VA (US); Robert L. Ripley, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 434 days.

(21) Appl. No.: 10/649,792

(22) Filed: Aug. 28, 2003

(65) Prior Publication Data

US 2005/0045198 A1 Mar. 3, 2005

(51) Int. Cl.
*A24F 13/00* (2006.01)
*A24F 17/00* (2006.01)
*A24F 25/00* (2006.01)

(52) U.S. Cl. ..... 131/329; 131/328; 219/222

(58) Field of Classification Search ..... 131/194, 131/243

See application file for complete search history.

(56) References Cited

U.S. PATENT DOCUMENTS 3,586,820 A * 6/1971 Yamanaka ..... 219/222
5,179,966 A 1/1993 Losee et al.
5,222,185 A 6/1993 McCord, Jr.
5,249,586 A 10/1993 Morgan et al.
5,269,327 A 12/1993 Counts et al.
5,388,594 A 2/1995 Counts et al.
5,505,214 A 4/1996 Collins et al.
5,530,225 A 6/1996 Hajaligol
5,591,368 A 1/1997 Fleischhauer et al.
5,726,421 A 3/1998 Fleischhauer et al.
5,878,752 A 3/1999 Adams et al.
5,934,289 A 8/1999 Watkins et al.
5,954,979 A 9/1999 Counts et al.
5,967,148 A 10/1999 Harris et al.
6,053,176 A 4/2000 Adams et al.
6,116,247 A 9/2000 Banyasz et al.
6,119,700 A 9/2000 Fleischhauer et al.
6,125,866 A 10/2000 Nichols et al.
6,418,938 B1 7/2002 Fleischhauer et al.

* cited by examiner

*Primary Examiner*—Steven P. Griffin
*Assistant Examiner*—Phu H Nguyen
(74) *Attorney, Agent, or Firm*—Buchanan Ingersoll & Rooney P.C.

(57) ABSTRACT

A dryer for a smoking device includes a heating element adapted to fit within a cigarette receiving portion of the smoking device, the heating element projecting from a base portion of the dryer. The base portion of the dryer has an interface surface on which the smoking device rests when the heating element is positioned within the cigarette receiving portion of the smoking device. At least one air passageway is provided in the base portion of the dryer to communicate between the cigarette receiving portion and surrounding ambient air when the smoking device rests on the interface surface.

5 Claims, 3 Drawing Sheets

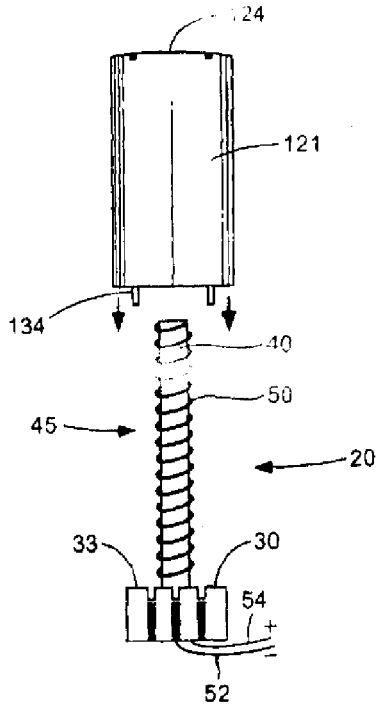

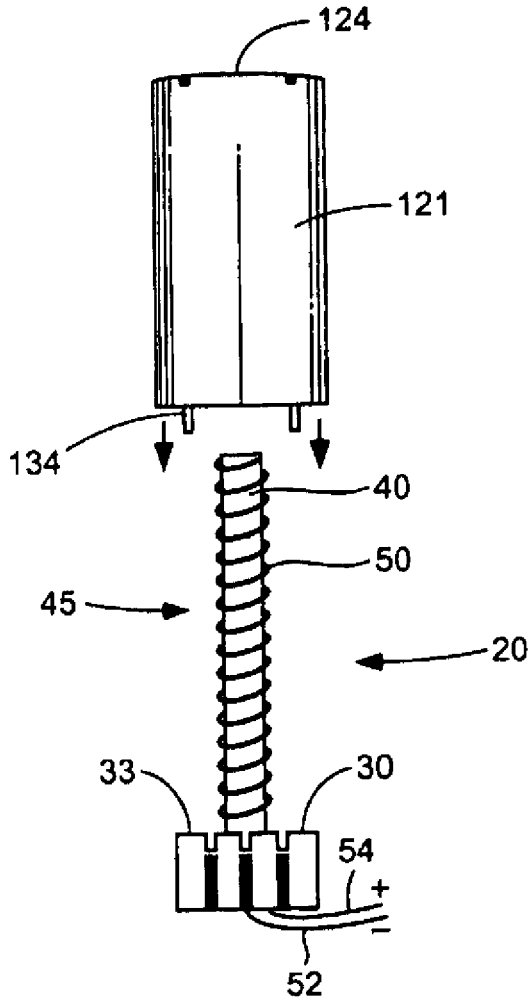
FIG. 1
FIG. 2
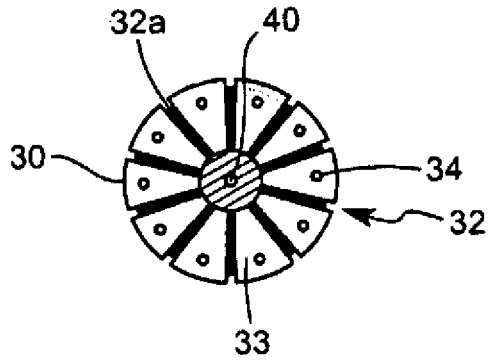
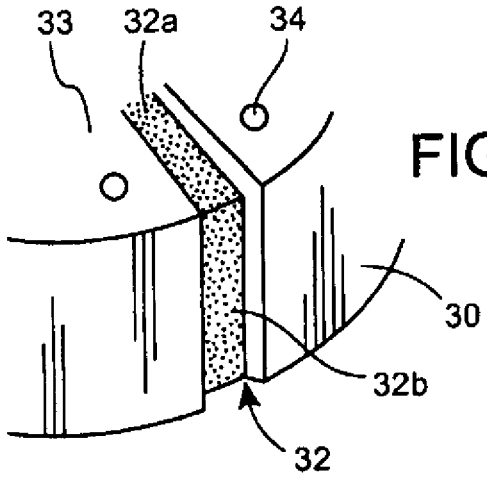
FIG. 3